United States Patent [19]

Flanagan

[11] 4,264,479

[45] Apr. 28, 1981

[54] SURFACTANT SYSTEM

[76] Inventor: John J. Flanagan, 8950 S. Leavitt Ave., Chicago, Ill. 60620

[21] Appl. No.: 115,037

[22] Filed: Jan. 24, 1980

Related U.S. Application Data

[63] Continuation of Ser. No. 970,134, Dec. 18, 1978, Pat. No. 4,203,872, which is a continuation-in-part of Ser. No. 862,595, Dec. 20, 1977, Pat. No. 4,174,304, which is a continuation-in-part of Ser. No. 832,364, Sep. 12, 1977, abandoned, which is a continuation-in-part of Ser. No. 601,054, Aug. 1, 1975, Pat. No. 4,065,409.

[51] Int. Cl.[3] ..... C11D 1/75; C11D 1/825; C11D 1/835; C11D 1/94

[52] U.S. Cl. ..... 252/524; 252/106; 252/153; 252/156; 252/173; 252/174.21; 252/312; 252/356; 252/357; 252/527; 252/528; 252/529; 252/542; 252/546; 252/547; 252/548; 252/DIG. 1; 252/DIG. 14

[58] Field of Search ..... 252/106, 153, 156, 173, 252/174.21, 312, 356, 357, 524, 527, 528, 529, 542, 546, 547, 548, DIG. 1, DIG. 14

[56] References Cited

U.S. PATENT DOCUMENTS

| | | | |
|---|---|---|---|
| 3,296,145 | 1/1967 | Findlan | 252/106 |
| 3,351,557 | 11/1967 | Almstead | 252/106 |
| 3,537,993 | 11/1970 | Coward | 252/547 |
| 3,553,143 | 1/1971 | Bauer | 252/547 |
| 3,679,609 | 7/1972 | Castner | 252/527 |
| 3,812,046 | 5/1974 | Lancz | 252/106 |
| 3,843,563 | 10/1974 | Davies | 252/547 |
| 3,849,348 | 11/1974 | Hewitt | 252/547 |
| 3,862,045 | 1/1975 | Sato | 252/547 |
| 3,959,157 | 5/1976 | Inamorato | 252/547 |
| 4,065,409 | 12/1977 | Flanagan | 252/528 |
| 4,122,043 | 10/1976 | Kersnar | 252/527 |
| 4,203,872 | 5/1980 | Flanagan | 252/542 |

*Primary Examiner*—Dennis L. Albrecht
*Attorney, Agent, or Firm*—Kegan, Kegan & Berkman

[57] ABSTRACT

An improved surfactant system comprising a mixture of a non-ionic detergent, a tertiary amine oxide or amphoteric detergent, and a quaternary ammonium halide. The surfactant system of the invention is combined with other ingredients to yield 14 different commercially useful cleaners. Each of these cleaners has improved detergent properties compared with prior art cleaners.

1 Claim, No Drawings

SURFACTANT SYSTEM

BACKGROUND OF THE INVENTION

This application is a continuation of co-pending U.S. patent application Ser. No. 970,134, filed Dec. 18, 1978, now U.S. Pat. No. 4,203,872, which is a continuation-in-part of co-pending U.S. patent application Ser. No. 862,595 filed Dec. 20, 1977, now U.S. Pat. No. 4,174,304, which is a continuation-in-part of U.S. patent application Ser. No. 832,364 filed Sept. 12, 1977, now abandoned, which is a continuation-in-part of co-pending U.S. patent application Ser. No. 601,054 filed Aug. 1, 1975, now U.S. Pat. No. 4,065,409.

Various types of surfactant systems are known in the prior art, some of which include non-ionic detergents and tertiary amine oxides or amphoteric detergents. Occasionally, small proportions of a quaternary ammonium compound may be incorporated therein as a fabric softener or as an optional germicide. The present invention relates to an improved surfactant system including at least 8–50% by weight and preferably about 10–13% by weight, of a quaternary ammonium halide. Cleaning compositions incorporating the surfactant system of the invention have improved detergent properties compared with compositions containing only a non-ionic detergent combined with a quaternary ammonium halide, a tertiary amine oxide or amphoteric detergent combined with a quaternary ammonium halide, or an insufficient proportion of quaternary ammonium halide combined with a mixture of non-ionic detergent and tertiary amine oxide or amphoteric detergent.

It is a principal object of the present invention to provide a surfactant system having improved detergent properties compared with prior art surfactant systems.

Another object of the invention is to provide a surfactang system concentrate that is combined with other ingrediants and diluted with water to form at least 14 distinct preparations for cleaning hard surfaces.

It is a related object of the invention to provide a method for enhancing detersiveness with respect to vegetable oil and petroleum oils of a surfactant system comprising an aqueous solution of a non-ionic detergent and an amine oxide or amphoteric detergent.

Additional objects and advantages of the surfactant system of the invention will become apparent to persons skilled in the art from the following specification.

DETAILED DESCRIPTION OF A PREFERRED EMBODIMENT

The present invention relates to a surfactant system comprising an aqueous solution of a non-ionic detergent having a polyoxyethylene chain in its molecule; a tertiary amine oxide or an amphoteric detergent; and a quaternary ammonium halide. A viscosity reducing agent is also included to provide room temrperature viscosity consistent with ease of handling during use. Although the non-ionic detergent, the tertiary amine oxide or amphoteric detergent, and the quaternary ammonium halide used in this invention are each known to have detergent or surface-active properties, the invention is based upon the unexpected discovery that when the tertiary amine oxide or amphoteric detergent and non-ionic detergent are combined with a sufficiently high proportion of a quaternary ammonium halide, these ingredients provide a detergent effect which is much greater than is achieved through the use of only one or two of these material at equivalent concentrations. Although the reason for this result is not known, it appears that the quaternary ammonium halide has a potentiating or synergistic effect when it is combined in a sufficiently high proportion with the other two ingredients.

The non-ionic detergent used in this invention belongs to a class of compounds formed by condensation of an alkyl phenol, an alkyl amine, or an aliphatic alcohol with sufficient ethylene oxide to produce a compound having a polyoxyethylene chain within the molecule, i.e., a chain composed of recurring ($—O—CH_2—CH_2—$) groups. Many compounds of this type are known and used for their detergent, surface active, wetting and emulsifying properties. The detergents of this type which are useful in the present invention are those produced by condensation of about 4–16, and preferably 4–12, moles of ethylene oxide with 1 mole of a compound selected from the group consisting of (1) and alkyl phenol having about 1–15, and preferably 7–10, carbon atoms in the alkyl group; (2) an alkyl amine having about 10–20, and preferably 12–16, carbon atoms in the alkyl group; (3) an aliphatic alcohol having about 10–20, and preferably 12–16, carbon atoms in its molecule; and (4) a hydrophobic base formed by condensing propylene oxide with propylene glycol. Mixtures of two or more of the non-ionic detergent groups identified above may also be used. The number of moles of ethylene oxide which are condensed with one mole or parent compound (i.e., the alkyl phenol, the alkyl amine, or the aliphatic alcohol) depends upon the molecular weight of the hydrophobic portion of the condensation product. The non-ionic detergent used in the invention should have sufficient ethylene oxide units to insure solubility thereof in the detergent composition or in any dilution thereof which may be used in practice. In general, non-ionic detergents suitable for use in the invention can be formed by condensing the reactants in the proportions set forth above.

The alkyl phenols which can be condensed with ethylene oxide to give a non-ionic detergent useful in the invention are those in which the alkyl group contains about 1–15, and preferably about 7–10, carbon atoms in a straight or branched chain, which can be saturated or unsaturated. In a particularly preferred embodiment the non-ionic detergent is a mixture of detergents produced by condensation of 75% of 8–12 moles of ethylene oxide with 1 mole of nonyl phenol and 25% of 4–5 moles of ethylene oxide with 1 mole of nonyl phenol. Examples of other suitable alkyl phenol-ethylene oxide condensation products are those in which the hydrophobic portion of the product is formed from phenol, methyl phenol (cresol), ethyl phenol, hexyl phenol, octyl phenol, decylphenol, dodecylphenol, and the like.

Other non-ionic detergents which can be used in the invention are those wherein an alkyl amine or aliphatic alcohol, in which the alkyl group in which case has about 10–20, and preferably about 12–16, carbon atoms in a straight or branched chain which can be saturated or unsaturated, is condensed with about 8–16, and preferably about 9–13, moles of ethylene oxide. Examples of such compounds are the condensation products of ethylene oxide with decylamine, dodecylamine, tridecylamine, hexadecylamine, octadecylamine, and the like; and with decyl alcohol, dodecyl alcohol, tridecyl alcohol, hexadecyl alcohol, octadecyl alcohol and the like.

The second ingredient in the synergistic combination of surface active agents used in the invention can be a tertiary amine oxide selected from the following group:

(1) Alkyl di (lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples of such tertiary amine oxides useful in the invention include lauryl dimethyl amine oxide, myristyl dimethyl amine oxide, and those in which the alkyl group is a mixture of different chain lengths, such as lauryl/myristyl dimethyl amine oxide, dimethyl cocoamine oxide, dimethyl (hydrogenated tallow) amine oxide, and myristyl/palmityl dimethyl amine oxide.

(2) Alkyl di (hydroxy lower alkyl) amine oxides in which the alkyl group has about 10–20, and preferably 12–16, carbon atoms, and can be straight or branched chain, saturated or unsaturated. The alkyl group can contain 0 to 2 ether linkages, with 1 alkyl moiety containing from about 10 to 15 carbon atoms and no ether linkages. Examples are bis (2-hydroxyethyl) cocoamide oxide; bis (2-hydroxyethyl) tallowamine oxide; bis (2-hydroxyethyl) stearylamine oxide; and bis (2-hydroxyethyl) tridecyloxypropyl amine oxide.

(3) Alkylamidopropyl di (lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide.

(4) Alkyl morpholine oxides in which the alkyl group has about 10–20, and preferably 12–16, carbon atoms, and can be straight or branched chain, saturated or unsaturated.

Mixtures of any 2 or more of the amine oxide detergents identified above may also be used.

Alternatively, the second ingredient in the synergistic combination of surface active agents can be an amphoteric detergent selected from the following group, wherein:

$R_1$ is an alkyl radical containing from about 10 to about 14 carbon atoms.

$R_2$ and $R_3$ are each selected from the group consisting of methyl and ethyl radicals; and $R_4$ is selected from the group consisting of methylene, ethylene and propylene radicals.

(1) Betaine detergents having the formula

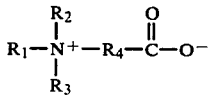

A suitable example is

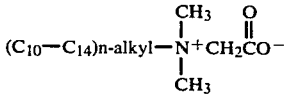

(2) Alkyd bridged betaine detergents having the formula

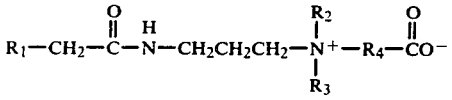

A suitable example is

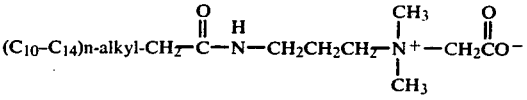

(3) Imidazoline detergents having the formula

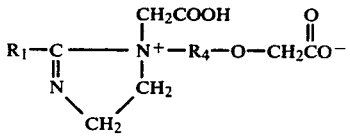

A suitable example is

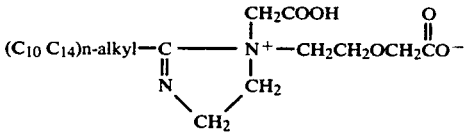

(4) Alkyliminopropionate detergents having the formula

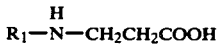

(5) Alkyliminodipropionate detergents having the formula

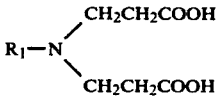

(6) Ether bridged alkyliminodipropionate detergents having the formula

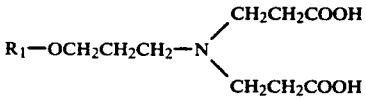

(7) Cocoimidazoline based amphoteric detergents having the formula

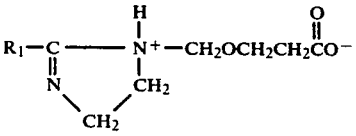

Mixtures of any of the amphoteric detergents with one another and with the amine oxide detergents listed above may also be used.

The third ingredient in the synergistic combination of surface active agents used in the invention is a quaternary ammonium halide surfactant having the formula

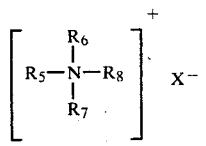

Quaternary ammonium halide surfactants useful in the invention are selected from the group consisting of:

(1) Compounds wherein $R_5$ and $R_6$ are lower (i.e., $C_1$–$C_7$) alkyl, and preferably methyl groups; $R_7$ is a lower (i.e., $C_1$–$C_7$) alkyl group or a benzyl group; $R_8$ is an alkyl group having about 1–18 carbon atoms substituted with a phenyl group, or an alkyl group having about 8–20, and preferably 8–18, carbon atoms; and X is a halogen, preferably chlorine. Examples of suitable quaternary ammonium halide surfactants include dioctyl dimethyl ammonium chloride, octyl decyl dimethyl ammonium chloride, didecyl dimethyl ammonium chloride, ($C_{12}$–$C_{18}$)n-alkyl dimethyl benzyl ammonium chloride, ($C_{12}$–$C_{14}$)n-alkyl dimethyl ethylbenzyl ammonium chloride, and dimethyl (difatty) ammonium chloride. In one embodiment of the invention the quaternary ammonium halide surfactant used is a mixture of about (34% by weight $C_{12}$ and 16% by weight $C_{14}$)n-alkyl dimethyl ethylbenzyl ammonium chloride, and about (30% by weight $C_{14}$, 15% by weight $C_{16}$, 2½% by weight $C_{12}$ and 2½% by weight $C_{18}$)n-alkyl dimethyl benzyl ammonium chloride.

(2) Compounds wherein $R_5$ $R_6$ and $R_7$ are lower (i.e., $C_1$–$C_7$) alkyl, and preferably methyl groups; $R_8$ is an alkyl or phenyl-substituted alkyl group having about 8–20, and preferably 8–18, carbon atoms; and X is a halogen, preferably chlorine.

(3) "Ethoquad" compounds wherein $R_5$ is an alkyl or phenyl-substituted alkyl group having about 10–20, and preferably 12–16, carbon atoms; $R_6$ is lower (i.e., $C_1$–$C_7$) alkyl and preferably a methyl group; $R_7$ is $[—CH_2CH_2O—]_xH$; $R_8$ is $[—CH_2CH_2O—]_yH$, with the sum of x+y varying between about 2 and 5; and x is a halogen, preferably chlorine. A suitable compound is ($C_{10}$–$C_{14}$)n-alkyl methyl dihydroxyethyl ammonium chloride, which is sold by Armak under the trade name Ethoquad C/12. Less satisfactory results are obtained using similar compounds in which the sum of x+y is considerably greater than 5. For example, a surfactant system including a quaternary ammonium halide surfactant as described above in which x+y =15 has less emulsifying power than a system including ($C_{10}$–$C_{14}$)n-alkyl methyl dihydroxyethyl ammonium chloride.

In the surfactant system concentrate of the invention, the non-ionic detergent is present in a concentration of about 25–75%, and preferable 40–50%, by weight; the tertiary amine oxide or amphoteric is present in a concentration of about 5–65%, and preferably 5–10%, by weight; the quaternary ammonium halide is present in a concentration of about 8–50%, and preferably 8–15%, by weight; and the remainder is water. Because of the relatively high concentrations of active ingredients, it is desirable to incorporate about 1–6% by weight of a viscosity reducing agent, preferably isopropanol. A particularly preferred surfactant system concentrate of the invention is described below as Example I.

EXAMPLE I—SURFACTANT SYSTEM CONCENTRATE

| INGREDIENT | % BY WEIGHT |
|---|---|
| Non-ionic detergent - condensation product of 9–10 moles of ethylene oxide with 1 mole of nonyl phenol | 44.2 |
| Tertiary amine oxide-lauryl dimethyl amine oxide | 7.2 |
| Quaternary ammonium halide - ($C_{10}$–$C_{14}$)n-alkyl methyl dihydroxyethyl ammonium chloride | 10.2 |
| Emulsion stabilizer - isopropanol | 2.9 |
| Water | 35.5 |

The surfactant system of Example I is combined with other ingredients and diluted with water to form the 14 different products identified below as Examples II through XV. It is a principal advantage of the surfactant system of the invention that these 14 products can be formulated close to the point of actual use from only one surfactant system rather than from three separate detergent ingredients. It is a related advantage that these 14 end products need not be shipped from the manufacturer to the actual user. Shipping costs are reduced by formulating the end products in greater proximity to the end user than the traditional distribution systems relying upon shipment of fully diluted end products.

Incorporated in the compositions of Examples II through V, VII through XI, XIII and XV are conventional builders commonly used in conjunction with synthetic detergents which function to improve the detergent properties of the compositions. The builders are typically alkaline salts such as the alkali metal carbonates, phosphates, and silicates. In addition to improving the detersive properties of the compositions, such builders control and maintain the pH of the bath, modify the adsorption of the detergent on the substrate and/or the soil and act as suspending or peptizing agents. Examples of suitable builders for use in the invention include sodium tripolyphosphate, tetra sodium pyrophosphate, trisodium phosphate, sodium carbonate, sodium orthosilicate, sodium metasilicate and the corresponding potassium salts. Alkali metal hydroxides such as sodium hydroxide and potassium hydroxide are used as builders when a higher pH is desired. Sodium hydroxide is added to the detergent compositions of Examples IV, V, VI, XII and XIII.

The three principal ingredients used in the surfactant system of Example I, being surface active agents, have a tendency to generate copious quantities of foam. The presence of foam is not necessary for production of a detergent effect and in many applications, including the mechanical or hand-mopping of a floor, foam is undesirable. Accordingly, the cleaning compositions of Examples II through VIII include small quantities of an anti-foam agent in a concentration sufficient to prevent foaming. Typically, small concentrations on the order of 0.001–0.01% by weight of an anti-foam agent can be used. The anti-foam agent can be any conventional type, including those based on silicones (e.g., methyl polysiloxanes) or other water-insoluble oils of low volatility and strong spreading power. Other anti-foam agents which can be used include glyceride oils, fatty acids, and higher alcohols and glycols.

In the cleaning compositions of Examples III, IV, X, XI, XIII and XV tetrasodium ethylene diamine tetraacetate (tetrasodium E.D.T.A.) is included as a water softening agent. Tetrasodium E.D.T.A. has the advantage of retaining its water softening power at higher temperatures than other traditional water softeners, thereby being suitable for high temperature applications such as in locations where steam is generated.

The following is a preferred composition of a degreasing cleaner for hard surface applications made in accordance with the present invention:

EXAMPLE II—DEGREASING CLEANER

| INGREDIENT | GALS. | WEIGHT (lb.) | % BY WEIGHT |
|---|---|---|---|
| Surfactant system concentrate (Example I) | .036 | 0.3 | 3.4 |
| Sodium Carbonate | | 0.15 | 1.7 |
| Sodium Metasilicate - Anhydrous | | 0.225 | 2.6 |
| Tetrasodium Pyrophosphate - technical grade | | 0.113 | 1.3 |
| Water | .964 | 8.0 | 91.0 |
| Defoamer | | 0.33 gm | .009 |
| Dye to suit | | 0.12 gm | |

The composition of Example II is homogeneous and stable against phase separation. It can be diluted with up to 100 or more parts of water to provide detergent solutions useful for a wide variety of hard surface cleaning applications.

The composition of Example II was tested by diluting it with water in the ratio of about 20 parts of water to 1 part of detergent concentrate. About 4 ounces of the diluted solution was placed into a beaker and about 2 cc. each of a vegetable oil and a used automobile crank case oil were added. On stirring by hand, the vegetable and petroleum oils were emulsified immediately.

For comparison, the above test was repeated using a detergent solution prepared from a commercially available hard surface detergent in which the detergent is partly composed of ethylene glycol monobutyl ether (butyl Cellosolve). When diluted to give a detergent solution containing an equal concentration of active ingredients, the commercial solution was unable to emulsify the added vegetable and mineral oils.

For a second test, there was employed a test procedure recommended by the Chemical Specialities Manufacturers Association (Tentative Method, revised Mar. 15, 1974, "Evaluating the Relative Efficiency of Aqueous Cleaners on Painted Surfaces"). In the test, glass panels coated with a standard white paint were marked by means of standard test pencils and crayons which are applied under controlled increasing pressure to the painted surface to form a series of lines. The detergent to be tested is evaluated for its ability to remove or reduce the intensity of the lines on the glass panels using a Gardner Strightline Washability Apparatus. The effectiveness of a test detergent solution is evaluated against the performance of a standard solution having the following composition.

| | |
|---|---|
| Sodium carbonate | 0.5% by weight |
| Sodium tripolyphosphate | 0.2% |
| Ethylene glycol monobutyl ether | 5.0% |
| Non-ionic detergent (condensation product of 1 mole of octylphenyl with about 10 moles of ethylene oxide) | 0.5% |
| Water | 93.8% |
| Total | 100.0% |

The detergent concentrate of Example II, diluted to a water content of 93.8% to match the standard solution, was evaluated against the standard. For use, each concentrate was diluted with water in the ratio of 20 parts water per 1 part of concentrate. The results showed that the solution of the invention was more effective in removing or lightening the applied markings. The concentrate of Example II achieved a rating of 7 (total removal) for the crayon markings, and a rating of 6 (faint trace of soil remaining) for the pencil markings.

The following Examples III through XIV are other cleaning compositions that are formulated from the concentrated surfactant system of Example I:

EXAMPLE III—NON-PHOSPHATE DEGREASER, EMULSIFIER AND CLEANER

| INGREDIENT | GALS. | WEIGHT (lb.) | % BY WEIGHT |
|---|---|---|---|
| Surfactant System Concentrate (Example I) | .036 | 0.3 | 3.5 |
| Sodium Metasilicate - Anhydrous | | 0.222 | 2.6 |
| Tetrasodium E.D.T.A. | | 0.72 | 0.8 |
| Defoamer | | 0.33 gm | 0.009 |
| Dye to suit | | 0.12 gm | |
| Water | .964 | 7.98 | 93.1 |

EXAMPLE IV—STEAM OR PRESSURE WASHING DEGREASING DETERGENT

| INGREDIENT | GALS. | WEIGHT (lb.) | % BY WEIGHT |
|---|---|---|---|
| Surfactant System Concentrate (Example I) | .036 | 0.3 | 3.4 |
| Sodium Metasilicate - Anhydrous | | 0.222 | 2.5 |
| Tetrasodium Pyrophosphate - Technical grade | | 0.099 | 1.1 |
| Sodium Hydroxide | | 0.195 | 2.2 |
| Tetrasodium E.D.T.A. | | 0.069 | 0.8 |
| Defoamer | | 0.33 gm | 0.008 |
| Dye to suit | | | |
| Water | .964 | 7.88 | 90.0 |

EXAMPLE V—HIGH PRESSURE SPRAY CLEANER AND HEAVY DUTY DEGREASER

| INGREDIENT | GALS. | WEIGHT (lb.) | % BY WEIGHT |
|---|---|---|---|
| Surfactant System Concentrate (Example I) | .036 | 0.3 | 3.4 |
| Sodium Metasilicate | | 0.22 | 2.5 |
| Tetrasodium Pyrophosphate | | 0.098 | 1.1 |
| Sodium Hydroxide | | 0.24 | 2.7 |
| Defoamer | | 0.33 gm | |
| Dye to suit | | | |
| Water | .964 | 8.03 | 90.3 |

EXAMPLE VI—HIGH STRENGTH STEAM CLEANER

| INGREDIENT | GALS. | WEIGHT (lb.) | % BY WEIGHT |
|---|---|---|---|
| Surfactant System Concentrate (Example I) | .036 | .30 | 3.4 |
| Sodium Hydroxide | | .43 | 4.9 |
| Sodium Gluconate | | .075 | 0.8 |
| Defoamer | | 0.33 gm | |
| Dye to suit | | | |
| Water | .964 | 7.9 | 90.8 |

EXAMPLE VII—AMMONIATED FLOOR STRIPPER AND DEGREASER

| INGREDIENT | GALS. | WEIGHT (lb.) | % BY WEIGHT |
|---|---|---|---|
| Surfactant System Concentrate (Example I) | .036 | 0.3 | 3.4 |
| Sodium Carbonate | | .15 | 1.7 |
| Sodium Metasilicate | | .225 | 2.6 |
| Tetrasodium Pyrophosphate | | .113 | 1.3 |
| Ammonia | | .053 | 0.6 |
| Defoamer | | 0.33 gm | 0.008 |
| Water | .964 | 7.95 | 90.4 |

EXAMPLE VIII—HEAVY DUTY DEGREASING CLEANER

| INGREDIENT | GALS. | WEIGHT (lb.) | % BY WEIGHT |
|---|---|---|---|
| Surfactant System Concentrate (Example I) | .0384 | .325 | 3.7 |
| Sodium Carbonate | | .15 | 1.7 |
| Sodium Metasilicate | | .23 | 2.6 |
| Tetrasodium Pyrophosphate | | .115 | 1.3 |
| Dye to Suit | | | |
| Water | .9616 | 8.01 | 90.7 |

EXAMPLE IX—CLEANER

| INGREDIENT | GALS. | WEIGHT (lb.) | % BY WEIGHT |
|---|---|---|---|
| Surfactant System Concentrate (Example I) | .0384 | .325 | 3.7 |
| Sodium Tripolyphosphate | | .346 | 4.0 |
| Dye to suit | | | |
| Water | .9616 | 8.01 | 92.2 |

EXAMPLE X—HEAVY DUTY NON-PHOSPHATE INDUSTRIAL CLEANER

| INGREDIENT | GALS. | WEIGHT (lb.) | % BY WEIGHT |
|---|---|---|---|
| Surfactant System Concentrate (Example I) | .038 | .325 | 3.8 |
| Sodium Metasilicate - Anhydrous | | .222 | 2.6 |
| Tetrasodium E.D.T.A. | | .07 | 0.8 |
| Dye to suit | | | |
| Water | .962 | 7.95 | 92.8 |

EXAMPLE XI—NON-PHOSHPATE CLEANER

| INGREDIENT | GALS. | WEIGHT (lb.) | % BY WEIGHT |
|---|---|---|---|
| Surfactant System Concentrate (Example I) | .038 | .3 | 3.5 |
| Sodium Carbonate | | .15 | 1.8 |
| Sodium Metasilicate (anhydrous) | | .045 | 0.5 |
| Borax (5 mole Sodium Borate) | | .052 | 0.6 |
| Tetrasodium E.D.T.A. | | .06 | 0.7 |
| Dye to suit | | | |
| Water | .962 | 7.9 | 92.9 |

EXAMPLE XII—WAX AND FLOOR FINISH STRIPPER

| INGREDIENT | GALS. | WEIGHT (lb.) | % BY WEIGHT |
|---|---|---|---|
| Surfactant System Concentrate (Example I) | .014 | .12 | 1.4 |
| Sodium Hydroxide | | .28 | 3.3 |
| Monoethanolamine | .086 | .72 | 8.5 |
| Isopropyl Alcohol | .01 | .065 | 0.8 |
| Dye to suit | | | |
| Water | 0.89 | 7.30 | 86.1 |

EXAMPLE XIII—HIGH FOAM DEGREASING CLEANER

| INGREDIENT | WEIGHT (lb.) | % BY WEIGHT |
|---|---|---|
| Surfactant System Concentrate (Example I) | 0.3 | 3.5 |
| Sodium Metasilicate | 0.22 | 2.6 |
| Sodium Hydroxide | 0.20 | 2.3 |
| Lauryl Dimethyl Amine Oxide | .15 | 1.7 |
| Tetrasodium E.D.T.A. | 0.07 | 0.8 |
| Dye to suit | | |
| Water | 7.68 | 89.1 |

EXAMPLE XIV—GLASS AND SMOOTH SURFACE CLEANER AND POLISH

| INGREDIENT | GALS. | WEIGHT (lb.) | % BY WEIGHT |
|---|---|---|---|
| Surfactant System Concentrate (Example I) | 0.00023 | .002 | .03 |
| Isopropyl Alcohol | 0.184 | 1.20 | 15.0 |
| Ethylene glycol monobutyl | 0.032 | .24 | 3.0 |
| Water | 0.784 | 6.53 | 81.9 |

EXAMPLE XV—SOAP FILM REMOVER

| INGREDIENT | GALS. | WEIGHT (lb.) | % BY WEIGHT |
|---|---|---|---|
| Surfactant System Concentrate (Example I) | .036 | 0.3 | 3.3 |
| Sodium Carbonate | | .13 | 1.5 |
| Sodium Metasilicate | | .20 | 2.2 |
| Tetrasodium Pyrophosphate | | .10 | 1.1 |
| Tetrasodium E.D.T.A. | | .42 | 4.7 |
| Isopropyl Alcohol | .033 | .22 | 2.4 |
| Water | .933 | 7.57 | 84.7 |

The foregoing detailed description of several preferred examples has been provided for clearness of understanding only, and no unnecessary limitations in the invention should be understood therefrom. Numerous additions and modifications therein will become readily apparent to persons skilled in the art without departing from the spirit and scope of the invention as set forth in the following claims.

What is claimed is:

1. A method for removing an oil-containing soil from fabrics and from hard surfaces by emulsifying oil contained in said soil, said method including the steps of preparing a surfactant system comprising:

A. about 25–75% by weight of a non-ionic detergent which is a condensation product of about 4–16 moles of ethylene oxide with one mole of a compound selected from the group consisting of (1) an alkyl phenol having about 7–10 carbon atoms in the alkyl group;

(2) an alkyl amine having about 12–16 carbon atoms in the alkyl group;

(3) an aliphatic alcohol having about 10–20 carbon atoms; and (4) a hydrophobic base formed by condensing propylene oxide with propylene glycol; and B. about 5–65% by weight of (1) an amine oxide selected from the group consisting of (a) alkyl di (lower alkyl) amine oxides in which the alkyl group has about 10–20 carbon atoms and the lower alkyl groups have about 1–7 carbon atoms;

(b) alkyl di (hydroxy lower alkyl) amine oxides in which the alkyl group has about 10–20 carbon atoms and contains from 0 to 2 ether linkages and has one alkyl moiety which contains from about 10 to 15 carbon atoms and no ether linkages, and the lower alkyl groups have about 1–7 carbon atoms;

(c) alkylamidopropyl di (lower alkyl) amine oxides in which the alkyl group has about 10–20 carbon atoms and the lower alkyl groups have about 1–7 carbon atoms; and (d) alkyl morpholine oxides in which the alkyl group has about 10–20 carbon atoms; or (2) an amphoteric detergent selected from the group consisting of (a) alkyd bridged betaine detergents having the formula

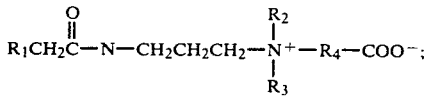

(b) imidazoline detergents having the formula

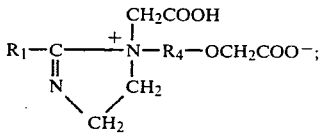

(c) alkyliminopropionate detergents having the formula

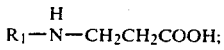

(d) alkyliminodipropionate detergents having the formula

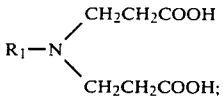

(e) ether bridged alkyliminopropionate detergents having the formula

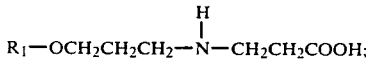

(f) ether bridged alkyliminodipropionate detergents having the formula

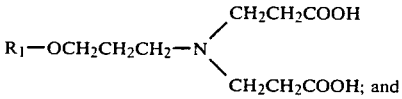

(g) cocoimidazoline based amphoteric detergents having the formula

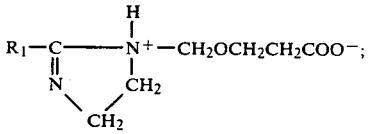

wherein $R_1$ is an alkyl radical containing from about 10 to about 14 carbon atoms, $R_2$ and $R_3$ are each selected from the group consisting of methyl and ethyl radicals, and $R_4$ is selected from the group consisting of methylene, ethylene and propylene radicals;

said method comprising the step of adding the said surfactant system,

C. about 8–50% by weight of a quaternary ammonium halide having the formula

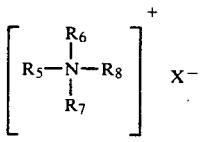

wherein X is a halid and the quaternary ammonium radical is selected from the group consisting of (1) radicals wherein $R_5$ and $R_6$ are lower alkyl, $R_7$ is a lower alkyl group or a benzyl group, and $R_8$ is an alkyl group having about 1–18 carbon atoms substituted with a phenyl group, or an alkyl group having about 8–20 carbon atoms;

(2) radicals wherein $R_5$, $R_6$ and $R_7$ are lower alkyl, and $R_8$ is an alkyl or phenyl-substituted alkyl group having about 8–20 carbon atoms; and (3) radicals wherein $R_5$ is an alkyl or phenyl-substituted alkyl group having about 10–20 carbon atoms, $R_6$ is lower alkyl, $R_7$ is $[—CH_2CH_2O—]_xH$, and $R_8$ is $[—CH_2CH_2O—]_yH$, wherein the sum of x and y is between 2 and 5, said method further comprising D. combining 1 part by weight of said surfactant system with from about 1 to about 3 parts by weight of alkaline builders and with up to about 100 parts by weight of water to provide a detergent concentrate;

E. diluting 1 part weight of said detergent concentrate with up to about 50 parts by weight of water to provide a detergent solution, and F. contacting said detergent solution with said oil-containing soil to emulsify oil contained in said soil thereby removing said soil from fabrics and from hard surfaces.

* * * * *

UNITED STATES PATENT AND TRADEMARK OFFICE

CERTIFICATE OF CORRECTION

PATENT NO. : 4,264,479

DATED : April 28, 1981

INVENTOR(S) : John J. Flanagan

It is certified that error appears in the above—identified patent and that said Letters Patent is hereby corrected as shown below:

Column 12, line 44, after "adding" insert -- to --;

Column 12, line 56 "halid" should read -- halide --.

Signed and Sealed this

*Fourteenth* Day of *July 1981*

[SEAL]

*Attest:*

GERALD J. MOSSINGHOFF

*Attesting Officer*

*Commissioner of Patents and Trademarks*